United States Patent [19]

Fruchard et al.

[11] Patent Number: 4,780,092

[45] Date of Patent: Oct. 25, 1988

[54] ELECTRICAL CONNECTOR

[75] Inventors: Charles Fruchard, Conflans Sainte Honorine; Herve Sarat, Osny, both of France

[73] Assignee: AMP Incorporated, Harrisburg, Pa.

[21] Appl. No.: 94,951

[22] Filed: Sep. 9, 1987

[30] Foreign Application Priority Data

Sep. 30, 1986 [FR] France ..... 86 13595

[51] Int. Cl.[4] ..... H01R 4/24

[52] U.S. Cl. ..... 439/395

[58] Field of Search ..... 439/395, 396, 397, 399, 439/400, 401, 402, 403, 406, 407, 408

[56] References Cited

U.S. PATENT DOCUMENTS

Re. 31,132 1/1983 Hoppe, Jr. .
3,926,498 12/1975 Hoppe, Jr. .
4,231,632 11/1980 Badoz et al. ..... 439/406
4,343,528 8/1982 Lucius et al. .
4,421,375 12/1983 Coldren .

OTHER PUBLICATIONS

AMP Mass Termination Assemblies, HB 5476, Rev A, 1984, pp. 1-26.

*Primary Examiner*—Joseph H. McGlynn
*Attorney, Agent, or Firm*—William B. Noll

[57] ABSTRACT

An electrical connector comprises a housing (51, 72) in which terminals (11, 71) are mounted in upper and lower rows with wire connecting portions (14, 82) of the terminals (11, 71) in longitudinally staggered relation aligned below a tool receiving opening (57) in the housing (51, 72) enabling a tool inserted through the opening (57) to terminate wires in both wire connecting portions (14, 82). The wire connecting portions (14, 82) define wire receiving slots (32) in panels (33) which have struts (39) extending into engagement with the housing (51, 72) during wire insertion to prevent collapse of the panels (33).

11 Claims, 3 Drawing Sheets

ELECTRICAL CONNECTOR

The invention relates to electrical connectors and terminals thereof.

Known connectors include terminals having wire connecting portions comprising wire receiving slots into which wires can be forced by tooling inserted through an opening in an insulating housing in which the terminal is preloaded, thereby to terminate the wire.

However, for some applications it is desirable to use a housing of identical design to that also able to accommodate terminals having crimping ferrules instead of wire receiving slots. Such ferrules are of increased radial size to clamp the wire insulation so that the wire core is in precise alignment with the terminal.

The floor of the housing passageway receiving the terminal is formed with a recess to accommodate the ferrules but, in consequence, when the housing is used with a wire connecting portion comprising a wire receiving slot, a clearance exists between the portion of the terminal defining the slot and the housing and, in consequence, deformation of such portion and slot may occur as a result of the force imposed to insert the wire into the slot by tooling having an insertion stroke perpendicular to the floor.

According to one aspect of the invention, a portion of the connector defining the slot is provided with a strut engaging the housing floor during the wire insertion stroke to resist collapse of such portion.

According to another aspect, it is desirable to terminate wires in terminals preloaded in a housing and arranged in two rows by inserting a tool through a tool receiving opening in the housing. In a prior proposal, it has been necessary to provide two access openings on respective opposite sides of the housing to enable termination of the wires in respective rows but this required either the housing to be turned over after termination in one row to align the other opening with the tool or a complex tool acting in two insertion directions.

According to this other aspect of the invention, the housing is adapted to mount wire connecting portions of terminals in first and second, upper and lower rows in longitudinally staggered relation so that the wires connecting portions are both aligned below a tool receiving opening on only one side of the housing, enabling termination of the wires in both rows by a tool having an insertion stroke acting in only a single direction. This enables simplification of assembly line tooling which is desirable for economical achievement of high production rates.

In addition, according to further aspects, the invention is directed to a terminal structure enabling the contact and wire connecting portions to be of different widths and the effective location of the terminals in a housing.

An example of a male and female connector comprising housings receiving male and female terminals, respectively, will now be described with reference to the accompanying drawings in which.

Figure 1:
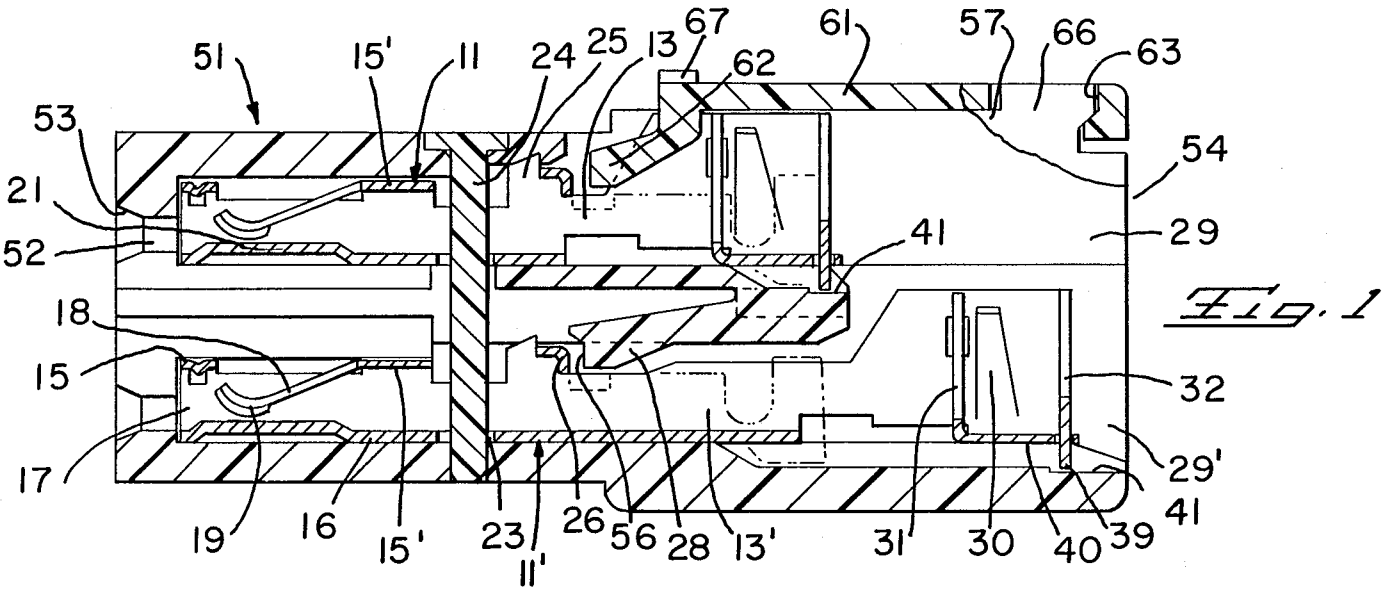
FIG. 1 is a cross-sectional view of the female connector.
Figure 2:
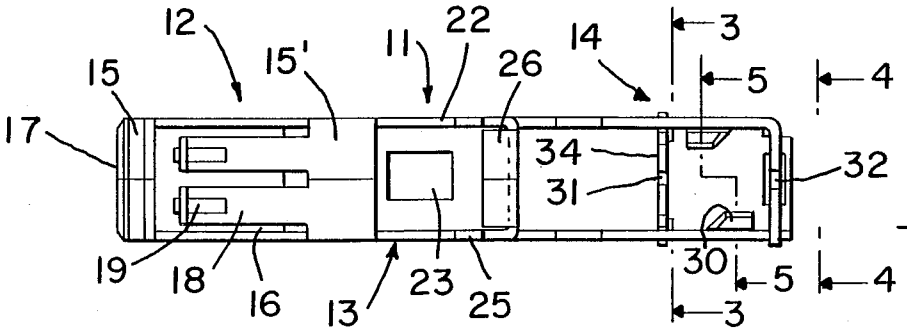
FIG. 2 is a plan view of the female terminal.

As shown in FIGS. 1-6, female terminals 11, 11' are substantially identical and are stamped and formed from single pieces of sheet metal stock, and comprise tab receiving receptacle portions 12 joined by body portions 13, 13' (which are of different lengths) to wire connecting portions 14. Each tab receiving portion 12 is of generally channel section with first and second pairs of extensions 15, 15', respectively, of the free edges of the channel side walls bent towards each other over the base 16 at a tab insertion end to define a tab restricting mouth 17 and to support a pair of cantilever spring contact arms 18 extending forwardly from the second extensions 15' into the channel with free ends 19 adjacent the base at a location rearwardly of the mouth 17. A portion 21 of the base 16 located between the extensions is pushed inwardly to provide a raised tab supporting platform below and opposite the spring arms 18.

Portions 22 of the side walls of the body portion 13 are of reduced height at a location adjacent the tab receiving portion 12 and an aperture 23 is cut in the base for receiving a terminal secondary locking comb 24. A pair of terminal retention tangs 25 project upwardly from free edges of the side walls rearwardly of the reduced height portion, and side wall extensions 26 of angle section are bent towards each other over the base adjacent and rearwardly of the tangs 25 to provide an abutment for engagement with a terminal retention arm 28 in a housing cavity 29.

Figure 6:
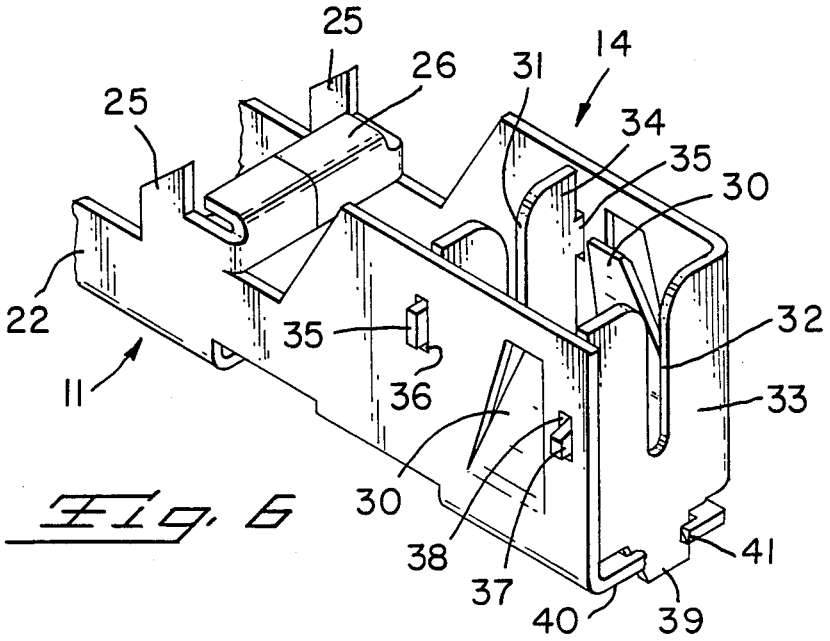
FIG. 6 is a perspective view of a wire connecting portion of the terminal.

As most clearly seen in FIG. 6, the wire connecting portion 14 is of generally open-topped box construction defined by first and second, axially spaced, aligned wire receiving slots 31 and 32, respectively, between which are located wire clamping arms 30 which are struck out from the side walls at axially staggered locations. The first wire receiving slot 31 is defined in a first panel 34 struck out from stock in the plane of the base 40, bent up to upstand across the channel and secured upstanding by a pair of locking lugs 35 which extend from opposite edges, being receiving in apertures 36 formed in the opposite channels walls.

The second wire receiving slot 32 is defined in a second panel 33 formed from a rear extension of one side wall bent about a vertical axis to extend across the channel. A first locking lug 37 extends from an upright edge into an aperture 38 in the other channel wall and second lug 39 extends from the lower horizontal edge through an aperture 41 in the base for a substantial distance beyond the base, not only to lock the panel 33 across the channel, but to a location adjacent a base of a sunken portion 41 of the housing 51, as shown in FIG. 1, to provide a strut supporting the panel to resist substantial deformation or collapse of the panel 33 during wire termination.

Figure 3:
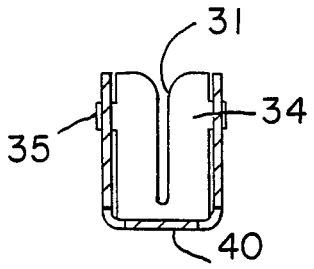
FIG. 3 is a cross-sectional view along lines 3—3 of FIG. 2.
Figure 4:
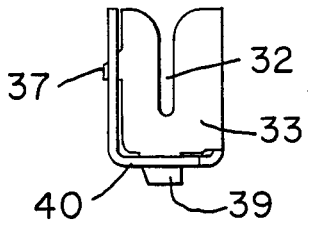
FIG. 4 is an end view along lines 4—4 of FIG. 2.
Figure 5:
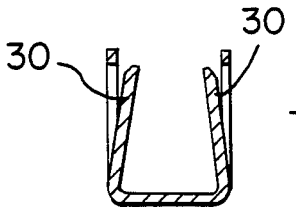
FIG. 5 is a cross-sectional view along lines 5—5 of FIG. 2.

It should be noted that, as shown in FIGS. 3 and 4, the first slot 31 is of smaller width than the second slot 32 and extends for substantially the entire height of the wire connecting portion 14 to the base, whereas the blind end of the second slot 32 is spaced further from the base.

The housing 51 is moulded in one piece of plastics material terminal receiving passageways 29, 29' arranged in upper and lower rows, respectively, communicating with a front mating face at a tab receiving mouth 53 of restricted size and with a rear wire receiving face 54. The passageways (shown closed by a cap 61 in FIG. 1) are open-topped adjacent the rear face and are staggered so that the lower row of passageways 29' extends beyond the upper row to provide clearance to admit wire terminating tooling in a direction transversely of the passageway axes to terminate wires in wire connecting portions 14 of terminals in respective rows of passageways simultaneously. A forwardly extending resilient terminal locking arm 28 having a terminal engaging notch 56 at a free end extends from the passageway ceiling at a location forwardly of the opening 57.

The floor of each passageway is stepped down adjacent the rear, providing a recess 41 to accommodate the insulation gripping portion of an alternative conventional crimping ferrule, for example as shown in broken lines. A pair of ribs 59 are formed on each side of the ceiling of lower passageways adjacent the locking arm for anchoring engagement with the tangs 25 to fix securely the terminals in the housing.

The cap 62 is also moulded of plastics material and is formed at a forward end with a row of resilient terminal locking arms 61 and at a rear end with a plurality of eyes 63 which receive hooks 66 upstanding from passageway side walls at the rear ends and cooperate with resilient hooks 67 upstanding inwardly from the side walls to latch the cap to the housing.

Figure 7:
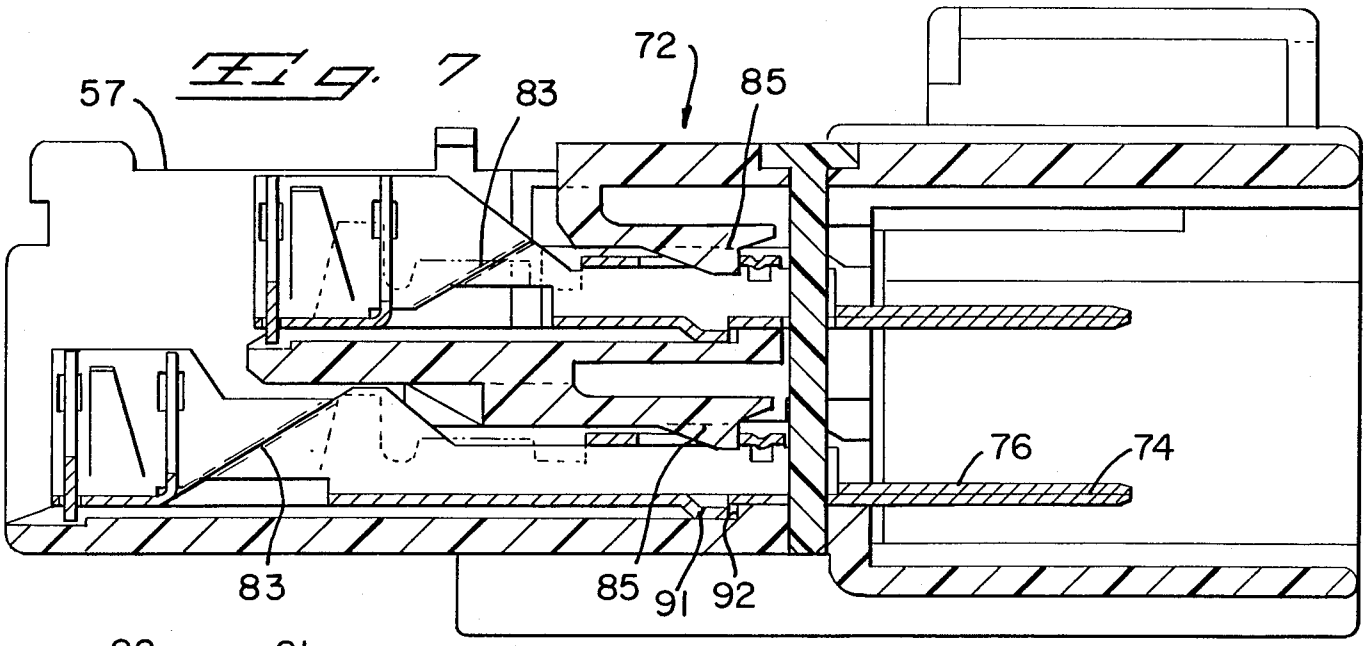
FIG. 7 is a cross-sectional view of the male connector with the cap removed; and, FIG. 8 is a plan view of the male terminal.
Figure 8:
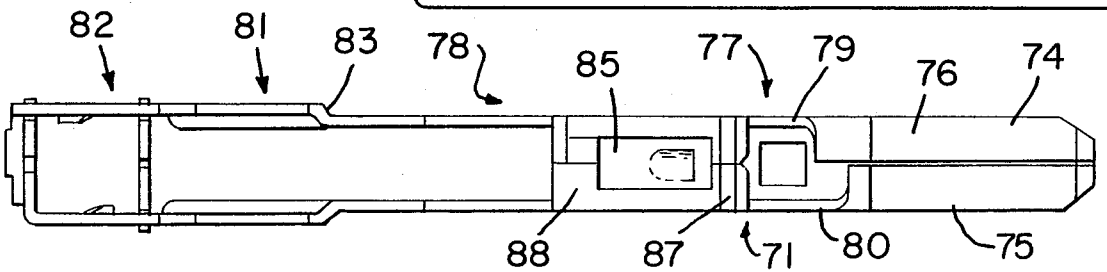

As shown in FIGS. 7 and 8, the male connector comprises a terminal 71 and housing 72, both having structural features which are similar to those of the female connector and which will not be described further.

The terminal 71 includes a tab 74 which is essentially the same as that described in AMP incorporated French Pat. No. 2320644, the disclosure of which is incorporated herein. The tab is formed by folding over marginal edge portions 75 and 76 of stock, one edge portion 76 extending further rearwardly than the other 75, and a transition region 77 being defined with a channel section mounting portion 78 in which forward ends of channel walls 79, 80 are offset longitudinally, one end terminating at the tab rear and the other extending forwardly of the tab rear to distribute stress in that region.

In a second transition region 81 between the mounting portion 78 and a wire connecting portion 82, the opposite walls 79, 80 are stepped inwardly along a line 83 extending from the base of the terminal adjacent the wire connecting portion 82, axially forwardly to the channel mouth or upper end adjacent the mounting portion 78 to provide a reduction in terminal width between the wire connecting portion 82 and the tab 74. This distributes stress along the terminal length effectively strengthening the terminal.

The housing 72 is formed with rows of resilient locking arms 85 received in apertures 86 defined by extensions 87, 88 of the walls 79, 80 bent towards each other over the base at longitudinally spaced locations to lock the terminals in the housing in cooperation with a stop 91 pushed out from the base to engage a shoulder 92 in the passageway bases to prevent forward movement.

Advantages of the above-described connector reside in the structure of the wire connecting portions of the terminals which can accommodate wires of different sizes (0.35 sq.mm. to 1.0 sq.mm. of standard wire core in one example), the first wire connecting slot 31 being more resilient than the second slot 32; the support provided by the strut 39 enabling the same housing design to be used to accommodate terminals with either enlarged wire insulation crimping ferrules or wire receiving slots; the particularly effective terminal retention in the housing; and, the staggered wire connecting portions and passageways which enable simultaneous termination of wires in the terminals in the lower and subsequently in the upper rows of passageways using tooling having a single insertion stroke.

We claim:

1. An electrical connector comprising an insulating housing (51, 72) formed with passageways (29, 29') communicating with opposite mating and wire receiving faces; and, a terminal (11, 71) stamped and formed from sheet metal stock received in the passageway (29, 29') with a contact portion (12, 74) adjacent a mating face and a wire connecting portion (14, 82) adjacent the wire receiving face, the wire connecting portion (14, 82) being of generally channel section and including a panel (33) defining a vertical wire receiving slot (32) bent from a side wall to upstand across the channel with the slot mouth opening at an upper edge of panel (33) to the channel mouth, the housing (51, 72) having a tool admitting opening (57) aligned over the slot (32) through which a terminating tool can be inserted to drive a wire into the slot (32), characterised in that, the housing base wall is formed with a recess (41) below the wire connecting portion (14, 82), the floor of which is spaced from the base (40) of the wire receiving portion, and a lug (39) extends from a lower edge of the panel through the channel base (40) to a location adjacent the floor of the recess (41) to provide a strut (39) supporting the panel (33) during the insertion of a wire into the slot (32) by the tool.

2. An electrical connector according to claim 1, characterised in that, the said (32) has a blind end located spaced above the channel base.

3. An electrical connector according to claim 1 or claim 2, characterised in that, the panel (33) comprises an extension of a side wall bent to extend across the base wall (40).

4. An electrical connector according to claim 3 characterised in that, another panel (34) including another wire receiving slot (31) extends across the channel with the other slot (31) aligned with the one slot (32), the other slot (31) extending to a location between the blind end of one slot (32) and the base (40) and for substantially the height of the channel.

5. An electrical connector according to claim 4 in which the walls of the other slot (30) are more flexible than the walls of the one slot (31) and the other slot (32) is narrower than the one slot (31).

6. An electrical connector according to claim 4, characterised in that, the other panel (34) is bent up from a stock portion coextensive with the base (40).

7. An electrical connector according to claim 4, characterised in that, an arm (30) is struck out from at least one side wall adjacent the one slot (31), which arm is deformable across the channel into clamping engagement with a wire received in a slot (31, 32).

8. A terminal for a connector according to claim 1, stamped and formed from sheet metal stock and comprising a contact portion (12, 74) and a wire connecting portion (14, 82), the wire connecting portion (14, 82) being of generally channel section and including a panel (33) bent from a side wall across the base (40) to define an upright wire receiving slot (32), characterised in that, a panel support lug (39) extends from a lower edge of the panel (33) through the channel base (40) to project downwardly therefrom, forming a strut for engagement with a support wall when a wire is forced into the slot.

9. An electrical connector comprising an insulating housing (51, 72) formed with upper and lower rows of passageways (29, 29') communicating with opposite, front, mating and rear, wire receiving faces (54) and having a terminating tool receiving opening (57) at a top adjacent the rear face and terminals (11, 71) received in respective passageways (29, 29'), characterised in that, the terminals (11, 71) in the passageways (29') of the lower row have wire connecting portions (14, 82) extending further rearwardly than the terminals (11, 71) of the passageways (29) of the upper row so that the wire connecting portions (14, 82) in respective rows are staggered longitudinally below and aligned with the tool receiving opening (57) so that wires can be terminated in the wire connecting portions (14, 82) of the terminals (11, 71) in the passageways (29', 29) of the lower and upper rows successively with the wires extending from the rear face of the housing by tooling inserted through the opening (57).

10. An electrical connector according to claim 9, characterised in that, the passageways (29) of the upper row terminate at locations spaced forwardly from the wire receiving face (54) of the housing (51, 72) and the passageways (29') of the lower row terminate at the wire receiving face (54).

11. An electrical terminal (71) stamped and formed from one piece of sheet metal with longitudinally spaced contact and wire connecting portions (74, 82) respectively, of channel section, joined by a transition portion (81) including a pair of spaced, opposed side walls (79, 80), characterised in that, the contact portion (74) and the wire connecting portion (82) are of different widths, the opposed walls (79, 80) of the transition portion being stepped inwardly along a line (83) extending from the base of one portion (74 or 82) of one width to the mouth of the other portion (82 or 74) of the other width so that the walls (79, 80) of the transition region (81) are coplanar with the walls of respective portions (79, 80) on each side of the step line (83).

* * * * *

UNITED STATES PATENT AND TRADEMARK OFFICE

CERTIFICATE OF CORRECTION

PATENT NO. : 4,780,092

DATED : Oct. 25, 1988

INVENTOR(S) : Charles Fruchard and Herve Sarat

It is certified that error appears in the above-identified patent and that said Letters Patent is hereby corrected as shown below:

In claim 2, column 4, line 35, change "said" to --slot--.

Signed and Sealed this

Eighteenth Day of April, 1989

*Attest:*

DONALD J. QUIGG

*Attesting Officer*

*Commissioner of Patents and Trademarks*